United States Patent [19]

Bartolini

[11] 3,983,778

[45] Oct. 5, 1976

[54] HIGH ASYMMETRY VARIABLE RELUCTANCE PICKUP SYSTEM FOR STEEL STRING MUSICAL INSTRUMENTS

[76] Inventor: William Bartolini, 1593 Sunset Drive, Livermore, Calif. 94550

[22] Filed: Aug. 21, 1974

[21] Appl. No.: 499,168

[52] U.S. Cl. ..... 84/1.15; 84/1.16

[51] Int. Cl.[2] ..... G10H 3/08

[58] Field of Search ..... 84/1.04, 1.14–1.16

[56] References Cited

UNITED STATES PATENTS

| | | | |
|---|---|---|---|
| 2,293,372 | 8/1942 | Vasilach | 84/1.14 |
| 2,911,871 | 11/1959 | Schultz | 84/1.15 |
| 3,066,567 | 12/1962 | Kelley, Jr. | 84/1.16 |
| 3,483,303 | 12/1969 | Warner | 84/1.15 |
| 3,571,483 | 3/1971 | Davidson | 84/1.16 |
| 3,588,311 | 6/1971 | Zoller | 84/1.15 |
| 3,629,483 | 12/1971 | Welch | 84/1.16 |
| 3,715,446 | 2/1973 | Kosinski | 84/1.15 |

FOREIGN PATENTS OR APPLICATIONS

| | | | |
|---|---|---|---|
| 1,176,145 | 1/1970 | United Kingdom | 84/1.16 |

*Primary Examiner*—Stanley J. Witkowski
*Attorney, Agent, or Firm*—David E. Newhouse

[57] ABSTRACT

A variable reluctance pickup system for steel string musical instruments is described which provides a highly asymmetrical magnetic field for preferentially sensing and generating electrical signals responsive to string vibrations perpendicular to the string plane. The described pickup system includes individual magnetic circuits with pole pieces, and a sensing coil for each string. The pickup system further includes special planar poletip faces which modify the spatial configuration of the magnetic fields emanating from the pole-pieces to render the pickup system relatively insensitive to "bending" of a string from its normal quiescent position. The described pickup system is designed to provide electronically amplified musical instruments with tonal characteristics similar to the tonal characteristics of acoustic string instruments.

30 Claims, 14 Drawing Figures

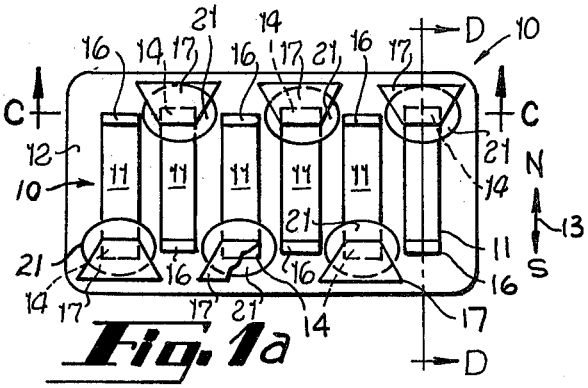
Fig. 1a
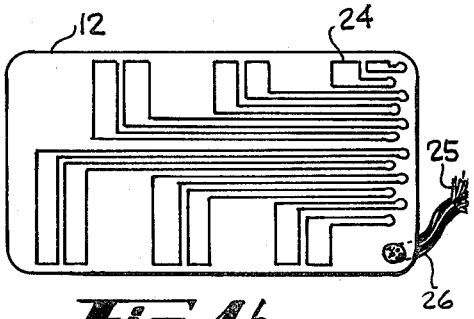
Fig. 1b
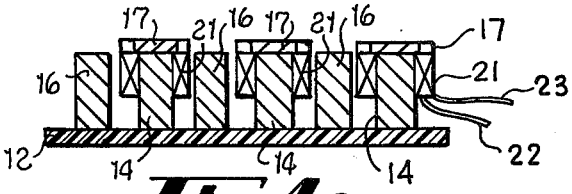
Fig. 1c
Fig. 1d
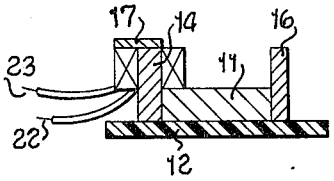
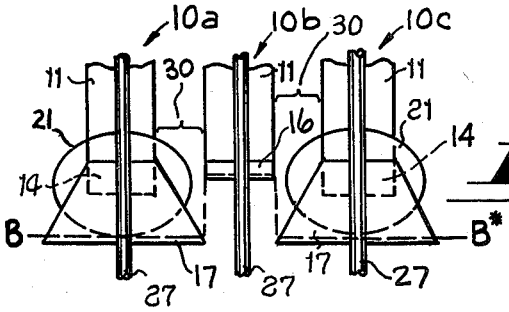
Fig. 2a
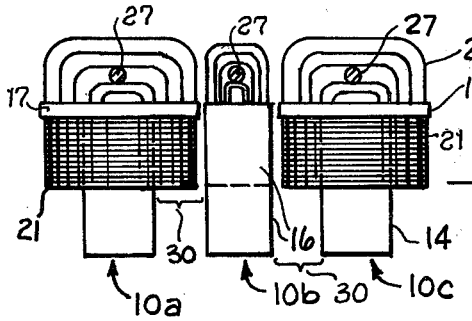
Fig. 2b
Fig. 3
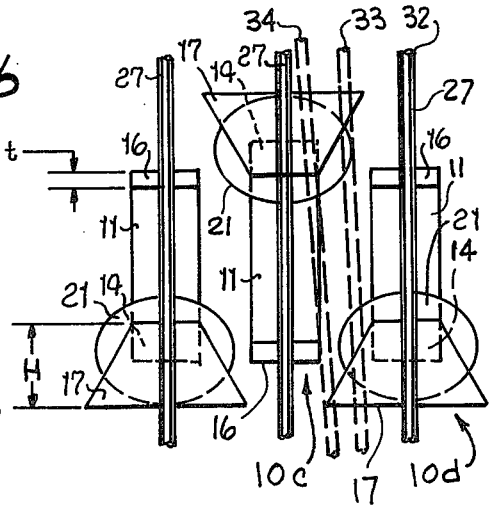
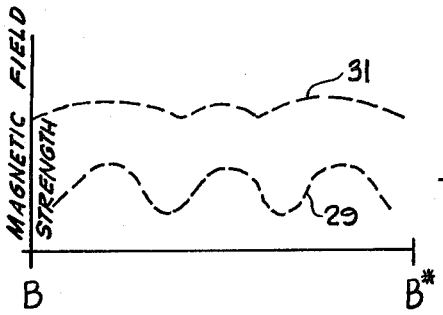
Fig. 2c

HIGH ASYMMETRY VARIABLE RELUCTANCE PICKUP SYSTEM FOR STEEL STRING MUSICAL INSTRUMENTS

BACKGROUND OF THE INVENTION

1. Field of the Invention

The invention relates to a variable reluctance pickup system for steel string musical instruments in which the vibrating strings cause variations of reluctance in a plurality of magnetic circuits generating electrical signals which, upon electronic amplification, are suitable for driving acoustic speaker systems.

2. Description of the Prior Art

Generally, variable reluctance pickup systems for steel string instruments comprise an arrangement of magnets and magnetically susceptible materials which establish a magnetic circuit in combination with the playing string. As the string vibrates, the changes in its position affect the reluctance and magnetic flux of the magnetic circuit. A sensing coil is inductively linked to the magnetic circuit for converting the variations in magnetic flux into a corresponding electrical signal. The electrical signal from the sensing coil is amplified electronically and fed into an acoustic speaker system for producing musical sounds.

There are many different configurations of the basic elements of variable reluctance pickup systems for steel string instruments. For example, U.S. Pat. No. 2,235,983 (Demuth) describes the basic elements of a magnetic pickup suitable for pianos and the like. U.S. Pat. No. 3,066,567 (Kelley) describes a magnetic pickup system having a single permanent magnetic element with a plurality of pedestals to provide a specific pickup zone for a given instrument string in combination with a single sensing coil. U.S. Pat. No. 3,483,303 (Warner) describes a variable reluctance transducer or pickup system for steel string musical instruments in which an attempt is made to isolate the magnetic circuits formed by adjacent strings so as to minimize "cross talk" between the various strings. U.S. Pat. No. 3,571,483 (Davidson) describes a variable reluctance pickup system having a plurality of isolated magnetic circuits, each specifically designed to be substantially insensitive to the plane of string vibration. Finally, U.S. Pat. No. 3,715,446 (Kozinski) describes a magnetic pickup system having a balanced coil assembly for each string wherein each assembly includes a bar magnet supporting two circular pole pieces and two sensing coils disposed around the pole pieces.

Before discussing the disadvantages of prior art variable reluctance pickup systems, it is instructive to review the fundamental properties of string instruments which give them their characteristic tones.

Basically, the tone of a plucked or struck string instrument is judged by the richness and complexity of the acoustic output in the "attack" or beginning portion of a note. In acoustic string instruments, the bridge structure constrains the motion of the sound board such that those components of string motion which are perpendicular to the plane of the sound board are well amplified, while those components of string motion which are parallel to the plane of the sound board are not. The path described by any arbitrarily small segment of a smoothly released plucked string is a precessing elliptical orbit of decreasing radius which rotates about the quiescent position of the string. Accordingly, the asymmetrical amplification of string motion provided by the bridge of an acoustic instrument yields a rich, full and complex tone of continuously varying harmonic content. The richness and complexity of the tone produced by acoustic string instruments is the primary criterion for judging the quality of such instruments.

Furthermore, the preferential or asymmetrical amplification provided by the bridge structure in acoustic string instruments enhances the expressive ability of the instrument. Specifically, the musician can control the initial motion of the string by plucking either parallel to the sound board for a "thin or nasal" tone or perpendicular to the sound board for a "full or rich" tone.

Steel string guitars and other similar instruments have a particular capability which distinguishes them from most other western musical instruments. This capability is referred to as "bending". Bending is accomplished after a string is fretted and plucked by moving the fretting finger with the string across the finger board stretching the string. The stretching of the string during bending can raise the pitch of the note played by as much as seven semitones, a factor which greatly enhances the expressive ability of the instrument. However, bending a note also results in a large displacement of the string from its quiescent position.

From the preceding discussion, it can be seen that for a variable reluctance pickup system to provide good tone (by acoustic instrument standards) it must be highly asymmetrical in converting string motion to electrical signal output. Further, such a pickup system must have a capability for high frequency response in order to preserve the richness and fullness of the varying harmonics in the attack portion of a note. Finally, for steel string guitars and similar instruments, the pickup system must be relatively insensitive to string displacements due to bending. Accordingly, variable reluctance pickup systems which are substantially insensitive to the plane of string vibration cannot generate a good acoustic tone.

Pickup systems with circular pole pieces have a similar disadvantage since the configuration of the magnetic field provided by such circular pole pieces is in the form of a symmetrical sinusoidal shell. Accordingly, the string vibrating within the magnetic field will generate equal magnitude electrical signals for string vibrations parallel to the string plane and string vibrations perpendicular to the string plane. The string plane is parallel to the sounding board.

Variable reluctance pickup systems which seek to eliminate cross talk between strings have two basic disadvantages: (1) elimination of cross talk also eliminates the possibility of bending; (2) isolation requires pole pieces having very narrow configurations aligned along the axis of the string, hence the pickup preferentially senses and generates electrical signals for string motions parallel to the string plane (parallel to the sounding board).

Other disadvantages of prior art variable reluctance pickup systems relate to their poor high frequency response characteristics. Specifically, the high frequency response of a magnetic circuit depends on two factors: (1) the aperture of the magnetic circuit (length of string sensed by the circuit); and (2) the impedance of the sensing coil.

Decreasing the aperture of the magnetic circuit increases its high frequency response capability. Specifically, the electrical signal response of a magnetic circuit reflects a summation of the changes of reluctance in the circuit which in turn are induced by movement of the linear portion of the string sensed by the circuit. If the length of string sensed is long (a large aperture), then different portions of the string within the aperture can move in opposite directions without changing the reluctance of the circuit. Hence, high frequency vibrational modes of the string may not be sensed for large aperture magnetic circuits. Accordingly, decreasing the aperture of the circuit increases the high frequency response of the circuit.

Variable reluctance pickup systems described in the prior art having "U-shaped" magnetic circuits have relatively large apertures. A U-shaped magnetic circuit comprises a bar magnet and two extending pole pieces positioned along an instrument string.

The impedance characteristics of variable reluctance pickup systems relate to the self-resonant nature of the sensing coils. Specifically, the impedance of the sensing coils increases with increasing frequency up to a maximum at the resonant frequency, whereupon the impedance decreases. Below the resonant frequency, the impedance is dominated by inductive effects. Specifically, the vibrating string causes variations in the magnetic flux of the magnetic circuit. The resulting variations in magnetic flux in the vicinity of the sensing coil induces an electrical signal in the coil which, in turn, creates another magnetic field which "bucks" or opposes the variations in flux induced by the string (Lenz's Law). This effect "impedes" the signal and increases with increasing frequency.

Above the resonant frequency, the impedance is influenced by the capacitive effects between turns of the coil and between layers in the coil winding. Specifically, the changing current in one turn of the coil influences the current in the neighboring turns of the coil. This effect becomes larger with increasing frequency such that the coil behaves as a capacitive reactance with turn-to-turn capacitive leakage to ground. Accordingly, the output signal from the sensing coils falls off rapidly above the self-resonant frequency.

Since both the inductance and capacitance of a sensing coil vary linearly with its mean radius, replacing one coil by multiple small coils can reduce the impedance of the pickup system by a factor equal to the number of coils and raise the self-resonant frequency by a factor equal to the square root of the number of coils.

From the above discussion, it can be seen that prior art variable reluctance pickup systems having a single coil for sensing variations in the reluctance of the magnetic circuit will have poor high frequency response. The desirability of utilizing multiple sensing coils to enhance the high frequency response characteristics of variable reluctance pickup systems, while recognized in the prior art, has not been extensively utilized. For example, in Kozinski, each pole piece has a separate sensing coil, which coils are connected in series to reduce background noise due to electromagnetic fields (a conventional humbucking arrangement). However, the Kozinski pickup is extremely sensitive to string position and cannot generate a sustained and continuous output upon bending a string from its quiescent position.

SUMMARY OF THE INVENTION

The invented variable reluctance pickup system for steel string musical instruments provides a highly asymmetrical magnetic field for preferentially sensing string vibrations perpendicular to the string plane and sounding board, and generating representative electrical signals which, upon electronic amplification and input into an acoustical speaker system, produce tones or notes analogous to those produced by purely acoustical string instruments. Specifically, the invented pickup system includes individual magnetic circuits for each string where each circuit includes pole pieces, a sensing coil and poletip faces. The pole pieces and the poletip faces provide a magnetic field region proximate each string which has a large magnitude magnetic flux gradient in a direction perpendicular to the string plane and a small magnitude magnetic flux gradient in a direction parallel to the string plane (parallel to the sound board).

A particular novel feature of the pickup system relates to special planar poletip faces which spread the magnetic fields emanating from the pole pieces to enhance the asymmetrical qualities of the field region and to render the pickup system insensitive to bending of a string from its normal quiescent position.

In a particular embodiment of the invented pickup system, a plurality of magnetic elements are arranged in a bucking configuration, a factor which further enhances the asymmetrical quality of the magnetic field regions created by the elements. Other embodiments of the invented pickup system include a single magnetic element with single pole pieces having rectangular cross sections for each string. In all the embodiments of the invented pickup system, a single sensing coil is provided for each string, a factor which serves to minimize the aperture of each magnetic circuit in the pickup and which maximizes the high frequency response capability of the pickup system.

Other novel features of the invented variable reluctance pickup system relate to the fact that the individual magnetic circuits are mounted on a printed circuit board with separate paired conductive paths for each sensing coil. The printed circuit board is modified for connection to a shielded multiple conductor cable which allows for easy connection for stereo output (bass strings to one channel, treble strings to another), multi-phonic output (each string to a separate amplifier), as well as many other combinations. Moreover, the separate conductor output allows individual electronic control over the volume and tone quality of the notes generated by each string.

The primary object of the invented high asymmetry variable reluctance pickup system is to produce an electronic signal which, upon amplification and input into an acoustical speaker system, generates a tone of continuously changing harmonic content at its leading edge, yielding the rich and complex attack normally expected of the best acoustic instruments.

A gradient of a scaler function is a vector whose components at any point are the rates of change (the derivatives) of the function along the directions of coordinate or reference axes at that point. In vector analysis a gradient of a scaler function $f(x,y,z)$ is symbolized as grad $f(x,y,z)$ and is defined as follows:

> "The gradient of a scaler function is a vector whose magnitude is the maximum directional derivative at the point being considered and whose direction is the direction of a maximum directional derivative at the point." (See Reitz and Milford, Foundations of electromagnetic Theory (1964, page 7; and K. R. Symon, Mechanics QD, page 95.)

Magnetic flux is a scaler function and is typically symbolized by the Greek letter Φ. (See J. R. Reitz and F. J. Milford, *Foundations of Electromagnetic Theory*, (supra). Sections 8–9, page 166, and D. R. Corson and P. Lorraine, *Introduction to Electromagnetic Fields and Waves*, (supra), Section 5.2, page 197.

Further, an inherent feature of a vibrating string instrument limits the utility of vector quantity grad Φ in three-dimensional space for describing the magnetic fields provided by variable reluctance pickups. Specifically, the rate of change of magnetic flux along the direction of the string is not important, since an arbitrarily small string segment (ds) does not change its position along the string axis The essence of the invention is that $(d\Phi/dh) << (d\Phi/dv)$. In language, $(d\Phi/dh) << (d\Phi/dv)$ states that the rate of change of magnetic flux in the horizontal direction is much less than the rate of change of magnetic flux in the vertical direction. The rate of magnetic flux in the horizontal direction approaches zero, or $(d\Phi/dh) \rightarrow 0$.

Another object of the invented high asymmetry variable reluctance pickup system relates to providing some separation in the output from adjacent strings in order to minimize overlap in the stereo and separate amplifier configurations.

Still further objects, advantages and novel features of the invented high asymmetry variable reluctance pickup system will become apparent upon examination of the following detailed description of the basic elements of the invention, together with the accompanying figures.

DESCRIPTION OF THE FIGURES

FIG. 1*a* shows a top view of the basic elements of the invented high asymmetry variable reluctance pickup system.

FIG. 1*b* shows a top view of the printed circuit board on which the elements of the high asymmetry variable reluctance transducer are mounted.

FIG. 1*c* shows a cross-sectional view of the high asymmetry variable reluctance pickup system taken along line C—C of FIG. 1*a*.

FIG. 1*d* is another cross-sectional view of the high asymmetry variable reluctance pickup system taken along line D—D of FIG. 1*a*.

FIG. 2*a* is an enlarged partial top view of the high asymmetry variable reluctance pickup showing placement of the elements of the pickup in relation to the strings of a musical instrument.

FIG. 2*b* is a partial end view of the basic elements of the pickup system of FIG. 2*a* showing the configuration of the lines of equal magnetic field strength in relationship thereto.

FIG. 2*c* depicts the strength of the magnetic field emanating from the high asymmetry variable reluctance pickup system in a plane taken along line B—B of FIG. 2*a*.

FIG. 3 is a top view of the invented variable reluctance pickup system which illustrates the co-operation of the basic elements of the system upon bending of a string from its normal quiescent position.

DESCRIPTION OF PREFERRED EMBODIMENTS

Figure 4:
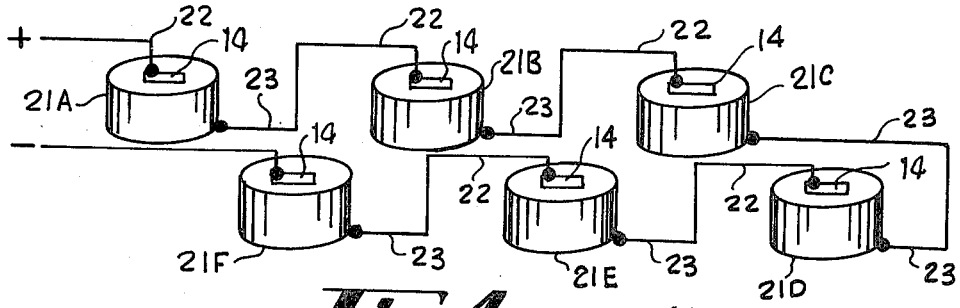
FIG. 4 is a schematic representation of the electrical connection of the sensing coils in a conventional humbucking arrangement.

Referring to FIG. 1*a*, the invented high asymmetry variable reluctance pickup system includes a separate magnetic circuit element 10 for each string of the musical instrument (in this case a 6 string instrument). Each magnetic circuit element 10 has a permanent bar magnet 11 insulatively mounted on a printed circuit board 12 (see FIG. 1*b*). The bar magnets 11 are oriented parallel to each other in a row with their north-south polarity axes (indicated by the arrow 13) aligned in a common direction parallel to the longitudinal axes of the strings of the musical instrument. (See FIG. 2*a*). Each magnetic circuit element 10 further includes two pole pieces, a primary pole piece 14 and a secondary pole piece 16. The primary pole piece 14 has a thick rectangular cross section in a plane parallel to the string plane, while the secondary pole piece 16 has a thin rectangular cross section in the plane parallel to the string plane. The primary pole pieces 14 are located on alternate north-south ends of adjacent bar magnets 11. Planar poletip faces 17 are mounted on the end of each of the primary pole pieces. As shown in FIGS. 1*a* and 2*a*, the poletip faces 17 have a planar configuration of an isosceles trapezoid with a long base dimension approximately equal to the distance between the secondary pole pieces 16 of the adjacent magnetic circuit elements 10, and a short base dimension approximately equal to the width dimension of the primary pole piece 14.

The primary pole pieces 14, the secondary pole pieces 16 and the planar poletip faces 17 are composed of magnetically susceptible materials which serve to shape and direct the magnetic field provided by the bar magnets 11 into a plurality of asymmetrical magnetic field regions which encompass the strings.

Referring now to FIGS. 1*c* and 1*d*, sensing coils 21 are disposed around each of the primary pole pieces 14 between the planar poletip face 17 and the bar magnet 11. Each sensing coil has two leads, an inside lead 22 from the inside of the coil, and an outside lead 23 from the outside of the coil.

Referring now to FIG. 1*b*, the inside lead 22 and the outside lead 23 of each sensing coil 21 are connected to separate conductive strips 24 on the printed circuit board 12. A shielded multiple conductor cable 26 having a separate conductive wire 25 for each conductive strip 24 establishes the electrical connection between the sensing coils 21 and a suitable electronic amplification system. The amplification system amplifies the electrical signals produced in the coils 21 for driving a suitable acoustical speaker system.

Referring to FIG. 2*a*, the position of the magnetic circuit elements 10*a*, *b*, and *c* are shown relative to the quiescent position of the strings 27 of a musical instrument. Specifically, each magnetic circuit element 10 is centrally aligned beneath the quiescent position of a string 27 such that the string 27 is located centrally with respect to the magnetic field emanating from the pole pieces and poletip faces (See FIG. 2*b*). The magnetic fields emanating from the primary pole pieces 14, the secondary pole pieces 16, and the trapezoidal poletip faces 17 are illustrated by the lines of equal magnetic field strength 28 shown in FIG. 2*b*.

Specifically, since the polarity axes of the respective magnetic circuits are aligned in a common direction, the magnetic field of each circuit element 10 bucks the magnetic field of the adjacent magnetic circuit elements 10. In effect, each magnetic circuit element 10 has a separate magnetic field region which, in part, is shaped by the magnetic fields of the adjacent magnetic circuit elements 10.

The rectangular cross sections of the pole pieces 14 and 16 provide the magnetic field emanating therefrom with a large magnetic flux gradient in a direction perpendicular to the poletip face (perpendicular to the sounding board and string plane) and a small magnetic flux gradient in a direction parallel to the poletip face (parallel to the string plane and perpendicular to the string axes). From FIG. 2*b*, when the string 27 is moved perpendicular to the poletip face, it crosses a large number of lines of equal magnetic field strength 28 to generate a corresponding large change of reluctance in the magnetic circuit. However, when the string 27 is moved parallel to the poletip face, it crosses relatively few lines of equal magnetic field strength 28 and generates a correspondingly small change of reluctance in the magnetic circuit. The amplitude of the electrical signals generated in the sensing coils of the magnetic circuits 10 corresponds to the magnitude of the change of reluctance and, therefore, of magnetic flux in the circuits. Accordingly, it can be seen that the asymmetrical magnetic field regions provided by the magnetic circuit elements 10 tend to preferentially sense and generate electrical signals responsive to string motions perpendicular to the string plane.

The trapezoidal planar poletip face 17 on a primary pole piece 14 spreads the magnetic field emanating from the pole piece 14 over the entire area of its planar face 17 to enhance the asymmetrical configuration of the magnetic field in that region. More particularly, referring to FIG. 2*c*, line 29 shows the contour of the bucking magnetic field regions provided by the magnetic circuit elements 10 in the absence of the trapezoidal planar poletip faces 17. As illustrated, the strength of the magnetic field drops off significantly in regions between the magnetic circuits, a factor which increases sensitivity to linear motion of the string from its quiescent position which occurs during bending. The field drop-off in the regions between the magnetic circuits prevents a sustained, continuous tone upon bending.

Line 31 of FIG. 2*c* shows the strength of the magnetic field emanating from the separate magnetic circuits with the trapezoidal poletip faces 17. The lines 29 and 32 indicate measurements taken along line B—B* of FIG. 2*a*. Specifically, as can be seen from FIG. 2*c*, the poletip faces 17 eliminate the drop-offs or dips in the magnetic field between the respective magnetic circuit elements 10, thus rendering the pickup system insensitive to bending. Specifically, the pickup system is capable of generating a sustained and continuous tone or note upon bending of a string.

More importantly, the trapezoidal poletip faces 17 spread the magnetic field emanating from the primary pole pieces 14 into the space 30 between the magnetic circuit elements 10. The space 30 between the magnetic circuit elements is determined by the spacing between the respective strings 27 of the particular musical instrument. Absent the planar poletip faces 17, a vibrating string 27, upon bending across the space 30 between the magnetic circuit elements 10, would not generate a continuous signal but, rather, would generate a signal which would decrease significantly in magnitude as the string passes over the space 30.

However, with the poletip faces 17, a string 27 vibrating about its quiescent position will primarily generate a signal in the magnetic circuit therebelow. Referring to FIG. 3, as the vibrating string moves from its normal quiescent position 32 to the bending position 33, it generates a signal both in the magnetic circuits 10*c* and 10*d*, with the primary component of the signal being provided by the magnetic circuit 10*d*. As the string 27 moves further to the deep bending position 34, a signal is generated in the magnetic circuits 10*c* and 10*d*. However, in the latter case, the primary component of the signal is provided by the magnetic circuit 10*c*. Accordingly, the string 27 can be moved from its normal quiescent position 32 to the deep bending position 34 without a significant decrease in the signal output from the pickup system. In fact, it is possible to shape the configuration of the planar poletip faces such that there is an enhanced signal output from the acoustic speaker system as the vibrating string 27 moves off its quiescent position 32. Specifically, the aperture of the magnetic circuit elements 10 (the minimum length of string sensed by the circuit) is basically determined by the height dimension (H) of the trapezoidal poletip face 17. Hence, while the strings 27 vibrate about their normal quiescent positions 32, there is a relatively high degree of separation between the signals input into the electronic amplification system (greater than 20 decibels) from the separate magnetic circuits. However, as can be seen from FIG. 3, as a string 27 moves or is bent from its normal quiescent position 32, it begins to establish an aperture with respect to the adjacent magnetic circuit element 10*c* in a different linear section of the string. As the string 27 moves further away from its quiescent position 32, its aperture increases with the second magnetic circuit element 10*c* while its aperture decreases with the first magnetic circuit element 10*d*. Accordingly, a continuous electrical signal is produced by the combination of the first and second magnetic circuit elements as the string moves from the quiescent position 32 to the deep bending position 34. The amplitude of the electrical signal (the sum of the outputs of the two sensing coils) is determined by the aperture of each magnetic circuit as the string moves. Hence, by properly shaping the planar poletip faces 17, it is possible to provide an enhanced electrical signal. Such an enhanced response characteristic is particularly desirable since such enhancement counteracts the decay in amplitude of string vibration experienced during a bending movement.

The secondary polepieces 16 do not significantly affect the aperture of the magnetic circuits 10. In fact, the primary function of the secondary pole pieces 16 is to provide a more efficient flux return path in the magnetic circuit. In fact, a magnetic circuit element 10 with a thick rectangular primary pole piece 14 and a thin rectangular secondary pole piece 16 preserves the signal generating efficiency of a U-shaped magnetic circuit element while minimizing its aperture.

More particularly, the height dimension (H) of the planar trapezoidal poletip face 17 and the thickness ($t$) of the secondary pole piece 16 determine, to a large degree, the aperture of the magnetic circuit element 10. In explanation, the primary and secondary pole pieces 14 and 16 provide high efficiency magnetic flux return paths because they are composed of magnetically susceptible materials. Increasing the height dimension of the trapezoidal planar poletip face 17 increases the length of string intersecting the magnetic field region emanating therefrom. Analogously, decreasing the thickness and/or height of the secondary pole piece 16 decreases the linear length of the string intersecting the magnetic field region forming the magnetic circuit. Specifically, decreasing the thickness or reducing the height of the secondary pole piece decreases its efficiency as a magnetic flux return path to the end of the bar magnet 11. Accordingly, as the efficiency of the secondary pole piece for providing a magnetic flux return path decreases, so does the aperture of the magnetic circuit element.

The primary pole pieces 14 are disposed alternatively on opposite magnetic poles of the bar magnets 11. Accordingly, the sensing coils 21 disposed around the primary pole pieces may be electrically connected in series in a humbucking arrangement, using the conductive wires 25 of the shielded multiple conductor cable 26. The humbucking connection system is schematically shown in FIG. 4. Specifically, the inside lead 22 of the sensing coil 21A is electrically connected to the positive terminal of the amplifying system. The outside lead 23 of the sensing coil 21A is electrically connected to the inside lead 22 of the sensing coil 21B, while the outside lead 23 of the sensing coil 21B is electrically connected to the inside lead 22 of the sensing coil 21C. Now, sensing coils 21A, B and C are disposed around the primary pole pieces 14 of north polarity, while sensing coils 21D, E and F are disposed around the primary pole pieces 14 of south polarity. Accordingly, the outside lead 23 of the coil 21C must be connected to the outside lead of the first south polarity coil 21D. Continuing, the inside lead of the sensing coil 21D is electrically connected to the outside lead 23 of the sensing coil 21E while the inside lead 22 of the sensing coil 21E is electrically connected to the outside lead 23 of the sensing coil 21F. The inside lead 22 of the sensing coil 21F is then connected to the negative terminal of the amplifier system.

When the coils are connected in a humbucking arrangement as just described, string vibrations generate electrical signals having the same positive or negative polarity. However, an external electromagnetic field will generate signals in the coils of opposite positive and negative polarity which cancel out, a factor which eliminates hum in the ultimate acoustic output of the system.

However, the impedance of each sensing coil 21 is low, for low frequency electromagnetic signals. Specifically, the sensing coils 21 are physically small and have a relatively short wire length when compared with single or double coil prior art pickup systems. Accordingly, the "hum" pickup of each sensing coil due to external electromagnetic fields is not significant.

Since there are separate conductive wires 25 in the multiple conductor output cable 26 for each sensing coil 21, and since the hum sensitivity of each coil is insignificant, a performer can electrically connect the sensing coils in any arrangement he desires. For example, he may connect the coils 21 generating electrical signals for bass strings of his instrument to one channel of an amplifier system, while connecting the coils generating electrical signals for the treble strings of his instrument to a second channel of the amplifier system. Alternatively, the performer could connect each coil 21 to a separate channel of an amplifying system to get multi-phonic output. Finally, the multiple conductor output for the sensing coils 21 gives the performer the ability for electronically amplifying, filtering, or otherwise modifying, the electrical signal output from each coil.

Figure 5B:
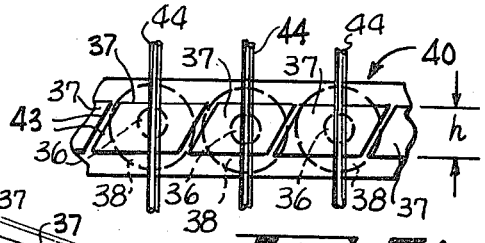
FIG. 5*b* is a partial top view of a high asymmetry variable reluctance pickup system shown in FIG. 5*a*, illustrating the configuration of the poletip faces.
Figure 5A:
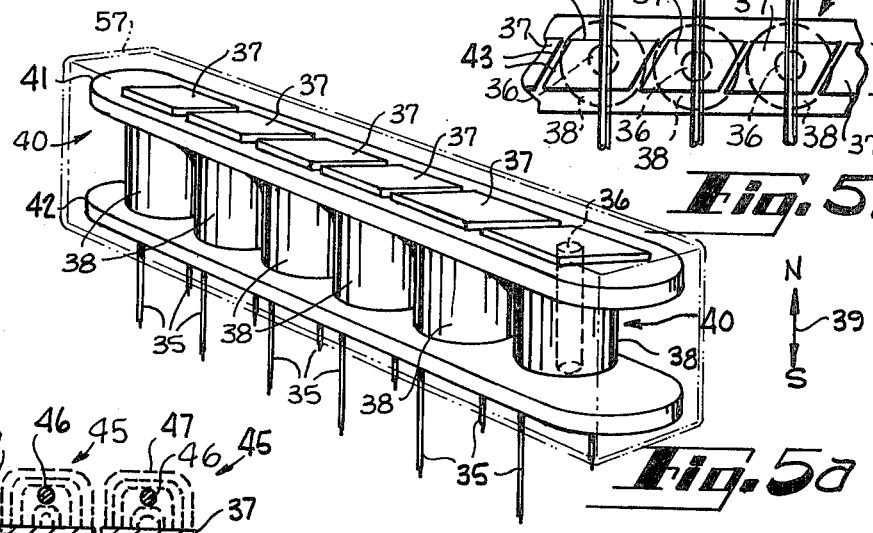
FIG. 5*a* is a perspective view of another embodiment of a high asymmetry variable reluctance pickup system wherein the magnetic elements and poletip faces are arranged in a T-configuration.

FIG. 5*a* shows another embodiment of a high asymmetry variable reluctance pickup system which includes a plurality of "T-shaped" magnetic circuit elements 40, each having a bar magnet 36, a planar pole face 37, and a sensing coil 38. The planar pole face 37 is composed of a magnetically susceptible material, such as iron, and has the general configuration of a parallelogram. The bar magnet 36 forms the shank of the T while the planar pole face 37 forms the crossbar of the T. The sensing coil 38 is disposed around the bar magnet 36 and has suitable inside and outside leads 35 adapted for electrical connection to an amplifier system.

More particularly, the bar magnets 36 have a small circular cross section and are oriented in a parallel row, each with its polarity axis aligned in a common direction (indicated by the arrow 39) perpendicular to the string plane 30. The bar magnets 36 are held in position by two structural members 41 and 42 composed of non-magnetic materials. The planar pole faces 37 are secured to the ends of the bar magnets 36 and arranged in a row on the top surface of the structural member 41.

Referring now to FIG. 5*b*, the height of each planar pole face 37 determines the aperture of the magnetic circuit element 40. The sides 43 of the planar pole face 37 are oriented at an angle with respect to the axes of the strings 44 of the instrument. Accordingly, the pickup system is relatively insensitive to bending of a string since, as the string moves from the aperture of a first magnetic circuit element, it moves into the aperture of a second magnetic circuit element. Hence, a vibrating signal will produce a sustained and continuous signal as it is moved in a bending motion.

Figure 5C:
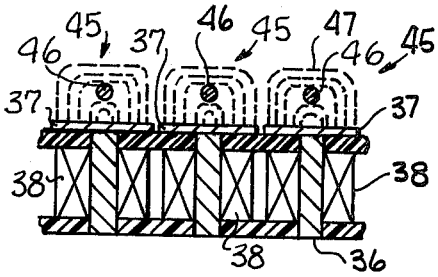
FIG. 5*c* is a cross-sectional view of the T-configuration pickup system and depicts the configuration of the lines of equal magnetic field strength.

Referring now to FIG. 5*c*, the planar pole face 37 spreads the magnetic field emanating from the circular bar magnet 36 over its entire surface area. Further, the magnets 36 are arranged in a bucking configuration. Accordingly, each magnet circuit 40 has a distinct magnetic field region 45. The configuration of the magnetic fields are shown by the lines of equal magnetic field strength, lines 47, in relationship to the quiescent string position 46. The combined effect of the bucking fields and shaping by the planar pole faces 37 give the magnetic field regions 45 a large magnetic flux gradient in a direction perpendicular to the planar pole faces 37 (perpendicular to the string plane) and a small magnetic flux gradient in a plane parallel to the planar pole faces 37. Accordingly, the pickup system will preferentially sense and generate electrical signals responsive to the string vibrations perpendicular to the plane of the planar pole faces 37 (perpendicular to the string plane).

The sensing coils 38 of the high asymmetry variable reluctance pickup shown in FIG. 5*a* cannot be connected in a humbucking configuration. However, since the coils are relatively small, external electromagnetic fields will not cause significant hum.

More particularly, the T-shaped magnetic circuit elements 40 are less efficient than the U-shaped magnetic circuit elements previously described because the magnetic flux return path does not occur through magnetically susceptible materials but, rather, occurs through air. Hence, in order to generate comparable electrical signals for variations in magnetic flux caused by a vibrating string, the coil size in the T-shaped elements 40 must be increased over that necessary for the U-shaped magnetic circuit elements 10. However, spacing between the respective strings of an instrument limits the maximum size of the coils 38, and the only way to increase coil size is to decrease the diameter of the bar magnet 36, thus diminishing the magnetic flux emanating therefrom. Accordingly, for the T-shaped magnetic circuit elements 40, the coil size and the diameter of the bar magnet 36 are largely determined by optimizing the required magnetic field strengths for good signal generation with the physical space parameters (string spacing) of the particular muscial instrument. If hum shielding is needed for a particular system, the pickup structure can be potted in an insulative epoxy 56 and then coated with a metallic paint 57. When properly grounded, the metallic paint 57 would shield the pickup system from external electromagnetic fields.

Figure 7:
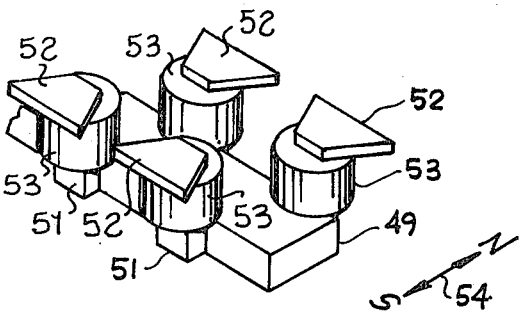
FIG. 7 depicts still another embodiment of a high asymmetry variable reluctance pickup system.

FIG. 7 shows still another embodiment of a high asymmetry variable reluctance pickup system which includes a single magnetic element 49 and single pole pieces 51 for each string of the instrument. The pole pieces 51 have a rectangular cross section. The system further includes planar poletip faces 52 having a planar configuration of an isosceles trapezoid. Sensing coils 53 are disposed around each of the pole pieces 51. The magnetic element 49 has a north-south polarity, indicated by the arrow 54. The pole pieces 51 are located on opposite polarity sides of the magnetic element 49 for adjacent strings. Again, the combination of the rectangular pole pieces 51 and the trapezoidal planar poletip faces 52 provide an asymmetrical magnetic field region surrounding each string of the instrument which preferentially senses and generates electrical signals responsive to string vibrations perpendicular to the plane of the poletip face. Since the pole pieces 51 are located on opposite polarity sides of the magnetic element 49, it is possible to connect the sensing coils 53 in a humbucking arrangement. The humbucking connection may be made by a printed circuit board mounted on the magnetic element 49. In such a case, the output cable need have only two conductors.

Figure 6:
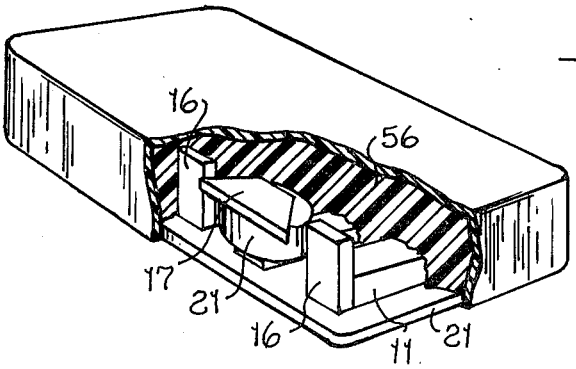
FIG. 6 is a perspective view of the finished high asymmetry variable reluctance pickup system in which the components of the pickup system are potted in an insulative epoxy material.

FIG. 6 shows the finished embodiment of the high asymmetry variable reluctance pickup system depicted in FIG. 1*a* potted in an insulative epoxy 56. The epoxy 56 forms a rigid matrix for holding the separate magnetic circuit elements in a fixed relationship to one another. In addition, the epoxy matrix greatly increases the durability of the pickup system.

While the invented high asymmetry variable reluctance pickup system for steel string musical instruments is described with respect to particular embodiments, schematics, and the like, numerous variations and modifications can be effected within the spirit and the scope of the invention as described above and as defined and set forth in the appended claims.

I claim:

1. In vibrating string musical devices which have a plurality of parallel strings composed of magnetically susceptible materials, said strings being oriented in a common string plane, a variable reluctance pickup for asymmetrically sensing vibrations of strings and generating corresponding electrical signals responsive thereto, comprising, in combination, a plurality of means each for forming a separate magnetic circuit in combination with a linear segment of one string, each including an individual means for shaping an individual magnetic field region encompassing one linear segment of one string, said magnetic field region having a magnetic flux gradient in a vertical direction (v) perpendicular to said string plane and perpendicular to said string segment ($d\Phi/dv$) for producing large changes of reluctance in said respective magnetic circuit responsive to motion of said linear string segment in said vertical direction, and having a very small magnetic flux gradient in a horizontal direction ($h$) perpendicular to said string and parallel to said string plane ($d\Phi/dh$), where $(d\Phi/dh) << (d\Phi/dv)$ for producing very small changes of reluctance in said respective magnetic circuit responsive to motions of said linear string segment in said horizontal direction, and means for sensing changes of reluctance in each of said magnetic circuits and producing an electrical signal responsive thereto, said means being adapted for electrical connection, whereby said produced electrical signals can be electronically amplified and converted into corresponding acoustic waves.

2. The variable reluctance pickup of claim 1 wherein said means for providing a separate magnetic circuit in combination with a linear segment of each string further includes a magnetic element providing a magnetic field having a north and a south side and a corresponding north-south polarity axis, said magnetic element being oriented with its north-south polarity axis aligned parallel to said strings, said magnetic element being disposed proximate said string plane.

3. The variable reluctance pickup of claim 2 further including a pole piece for each string, each of said pole pieces being positioned contiguous with a side of said magnetic element with an end proximate one of said strings, said pole pieces being composed of a magnetically susceptible material.

4. The variable reluctance pickup of claim 3, wherein said individual means for shaping the magnetic field provided by said magnetic element each comprise a planar pole tip face contiguous with the end of one pole piece having a planar face parallel to said string plane, for shaping the magnetic field emanating from the end of said pole piece into a magnetic field region surrounding the linear segment of one string, said magnetic field region having said magnetic flux gradient in said vertical direction ($v$), ($d\Phi/dv$) and said very small magnetic flux gradient in said horizontal direction ($h$), ($d\Phi/dh$) where $(d\Phi/dh) << (d\Phi/dv)$, said planar pole tip face being composed of magnetically susceptible material.

5. The variable reluctance pickup of claim 4, wherein said pole pieces for adjacent strings are positioned contiguous opposite north and south sides of said magnetic element.

6. The variable reluctance pickup of claim 5, wherein said ends of said pole pieces have a cross-sectional area in a plane parallel the string plane and said planar poletip faces have an area greater than said cross-sectional area of said ends of said pole pieces.

7. The variable reluctance pickup of claim 6, wherein said planar poletip faces have a minimum linear dimension equal to a distance between adjacent strings, said minimum linear dimension measured in a perpendicular relationship to said linear portions of said strings.

8. The variable reluctance pickup of claim 1 wherein said means for providing a separate magnetic circuit in combination with a linear segment of each string further includes, a magnetic element for each string having a north and a south end and a corresponding north-south polarity axis, said magnetic element being disposed in a parallel row with their north-south axes aligned in a common direction perpendicular to the string plane, each magnetic element providing a distinct magnetic field region for one string, which magnetic field bucks the magnetic field provided for adjacent strings, and wherein each of said individual means for shaping the magnetic field, shapes the distinct magnetic field provided by one of said magnetic elements into a distinct magnetic field region encompassing the linear segment of one string said magnetic field region having said magnetic flux gradient in said vertical direction ($v$), ($d\Phi/dv$) and having said very small magnetic flux gradient in said horizontal direction ($h$), ($d\Phi/dh$) where $(d\Phi/dh) << (d\Phi/dv)$.

9. The variable reluctance pickup of claim 8, wherein said individual means for shaping the magnetic fields provided by said magnetic elements comprises a plurality of planer pole tip faces each contiguous with an end of one magnetic element, which end is proximate the linear segment of said string, said planer pole tip faces each having a planer face lying in a plane parallel to the string plane, and said pole tip faces being composed of a magnetically-susceptible material.

10. The variable reluctance pickup of claim 9 wherein said planar poletip face has a minimum linear dimension equal to a distance between adjacent strings, said minimum linear dimension measured in a perpendicular relationship to said line segments of said strings whereby, upon a bending movement of any particular vibrating string from a normal quiescent position proximate to and above a first poletip face to a position proximate to and above a second poletip face adjacent to said first poletip face, a continuous resultant electrical signal is generated by said means for sensing changes of reluctance in the corresponding magnetic circuits.

11. The variable reluctance pickup of claim 10, wherein said means for sensing changes of reluctance in each of said magnetic circuits and for producing an electrical signal responsive thereto comprises a plurality of coils formed of insulative conductive wire, each disposed around one of said magnetic elements for generating an electrical signal responsive to a change of reluctance in a particular magnetic circuit, said coils being adapted for connection to suitable means for, amplifying and converting said electrical signals generated therein, into acoustic waves.

12. The variable reluctance pickup of claim 11, further defined in that said magnetic elements, said poletip faces, and said coils are potted in a rigid, insulative material to form a solid body and wherein said solid body is coated with a metallic paint.

13. In vibrating string musical devices which have a plurality of parallel strings composed of magnetically susceptible materials, said strings being oriented in a common string plane, a variable reluctance pickup for asymmetrically sensing vibrations of strings and generating corresponding electrical signals responsive thereto, comprising in combination, a plurality of separate magnetic elements, said elements being disposed in a parallel row, each of said magnetic elements having a north and a south end and a corresponding north-south polarity axis, the north-south polarity axis of said separate magnetic element being aligned in a common direction parallel with said strings, each of said magnetic elements forming a separate magnetic circuit in combination with a linear segment of one string, whereby the magnetic field provided by each of the magnetic elements bucks the magnetic field provided by the magnetic elements adjacent thereto, and a plurality of individual means each for shaping the magnetic field provided by one of said magnetic elements to provide a plurality of adjacent magnetic field regions, each magnetic field region encompassing the linear segment of one string and each magnetic field region having a magnetic flux gradient in a vertical direction ($v$), perpendicular to the string plane and perpendicular to said linear segment of said string, ($d\Phi/dv$), and having a very small magnetic flux gradient in a horizontal direction ($h$), perpendicular to the strings and parallel to the string plane, ($d\Phi/dh$), where $(d\Phi/dh) << (d\Phi/dv)$, for producing a maximum change of reluctance in the corresponding magnetic circuits responsive to motion of the linear string segment in said vertical direction, and for producing a very small change of reluctance in the corresponding magnetic circuits responsive to motion of the linear string segments in said horizontal direction, and means for sensing changes of reluctance in each of said magnetic circuits and producing an electrical signal responsive thereto, said means being adapted for electrical connection, whereby said produced electrical signals can be electronically amplified and then converted into corresponding acoustical waves.

14. The variable reluctance pickup of claim 13 wherein said individual means for shaping the magnetic fields provided by said plurality of separate magnetic elements each comprise, in combination, a primary pole piece having a longitudinal axis oriented at an angle with respect to said string plane and with respect to said polarity axes of said magnetic elements, said primary pole piece being positioned contiguous with one of said ends of one of said magnetic elements and extending toward said string plane for directing a distinct magnetic field encompassing said linear segment of one string, said primary pole piece being composed of a magnetically susceptible material and a planer pole tip face contiguous with the end of the primary pole piece proximate the string plane having a planer face parallel to the string plane for shaping the magnetic field emanating from the end of the primary pole piece into a distinct magnetic field region surrounding the linear segment of one string providing said magnetic field region with said magnetic flux gradient in said vertical direction ($v$), ($d\Phi/dv$) and with said very small magnetic flux gradient in said horizontal direction ($h$), ($d\Phi/dh$) where $(d\Phi/dh) << (d\Phi/dv)$, said pole tip face being composed of a magnetically susceptible material.

15. The variable reluctance pickup of claim 14, wherein said primary pole pieces are positioned contiguous alternate north and south ends of adjacent magnetic elements.

16. The variable reluctance pickup of claim 15, wherein said ends of said primary pole pieces proximate the string plane have a cross-sectional area in a plane parallel to the string plane and said planar face of said poletip faces have an area greater than said cross-sectional area of said ends of said pole pieces.

17. The variable reluctance pickup of claim 16, wherein said planar poletip faces have a minimum linear dimension equal to a distance between adjacent strings, said minimum linear dimension measured in a perpendicular relationship to said linear portions of said strings.

18. The variable reluctance pickup of claim 13 wherein said individual means for shaping the magnetic field provided by each of said magnetic elements each comprises a primary pole piece having a rectangular end face proximate and parallel to the string plane and having a longitudinal axis oriented at an angle with respect to said string plane and with respect to said polarity axis of said magnetic elements, said primary pole pieces being composed of a magnetically susceptible material and being positioned contiguous with an end of a magnetic element of opposite polarity than the polarity of the ends of adjacent magnetic elements having primary pole pieces positioned contiguous the ends thereof to shape a plurality of distinc magnetic field regions, each encompassing a linear segment of one string, each magnetic field region having said magnetic flux gradient in said vertical direction ($v$), ($d\Phi/dv$) and said very small magnetic flux gradient in said horizontal direction ($h$), ($d\Phi/dh$), where $(d\Phi/dh) \rightarrow 0$, whereby lines of equal magnetic field strength of each magnetic field region in a reference plane perpendicular to the end faces of said primary pole pieces and perpendicular with respect to said strings have a rectangular-like configuration.

19. The variable reluctance pickup of claim 18, further including a plurality of secondary pole pieces each composed of a magnetically susceptible material and having a rectangular end-face parallel to the string plane and having a longitudinal axis oriented at an angle with respect to said string plane and with respect to said polarity axes of said magnetic elements, said secondary pole pieces being positioned contiguous alternate north-south ends of said magnetic elements opposite said primary pole pieces to provide a plurality of distinct magnetic field regions contiguous to said magnetic field regions provided by said primary pole pieces for further shaping said magnetic field regions provided by said primary pole pieces to enhance the magnitude of the magnetic flux gradient in said vertical direction, ($v$), ($d\Phi/dv$) and to further decrease the magnitude of the very small magnetic flux gradient in said horizontal direction ($h$), ($d\Phi/dh$).

20. The variable reluctance pickup of claim 19, wherein said means for sensing changes of reluctance in each of said magnetic circuits comprises a plurality of coils formed of insulated conductive wire, each of said coils being disposed around one of said primary pole pieces for generating an electrical signal primarily responsive to a change of reluctance in a particular magnetic circuit, said coils each being adapted for connection to a suitable means for amplifying and converting said electrical signals generated therein into acoustic waves.

21. The variable reluctance pickup of claim 20 further defined in that the longitudinal axes of said primary and secondary pole pieces are oriented perpendicularly with respect to the string plane.

22. The variable reluctance pickup of claim 21 further including means for minimizing the length of the linear segment of each string forming a part of each magnetic circuit, whereby high frequency oscillation modes of said linear segment of said string generate corresponding high frequency electrical signal oscillations in the particular sensing coil.

23. The variable reluctance pickup of claim 22 wherein said means for minimizing the length of the linear segments of each string forming said magnetic circuits comprise, in combination, a. each primary poletip face having a length dimension ($L_p$) perpendicular to the polarity axis of the corresponding magnetic element, and a heighth dimension ($H_p$) parallel to the polarity axis of the magnetic element where the ratio of the heighth to the length ($H_p/L_p$) ranges between 0.05 and 1.0, and b. each secondary poletip face having a length dimension ($L_s$) equal to the length dimension ($L_p$) of the primary pole piece perpendicular to the polarity axis of the corresponding magnetic element and a width dimension ($W_s$) parallel to the polarity axis of the magnetic element where the length dimension ($L_s$) is much greater than the width dimension ($W_s$).

24. The variable reluctance pickup of claim 23, wherein the ratio of the width dimension and the length dimension of the secondary pole piece ($W_s/L_s$) ranges from 0 to 0.5.

25. The variable reluctance pickup of claim 21 further including means disposed on the end face of each primary pole piece further shaping the spatial configuration of the plurality of distinct contiguous magnetic field regions for generating a continuous resultant electrical signal in said sensing coils disposed around said first and second primary pole pieces upon a bending movement of any particular vibrating string from its normal quiescent position proximate and above a first primary pole piece to a position proximate and above a second primary pole piece adjacent to said first primary pole piece.

26. The variable reluctance pickup of claim 25, wherein said means disposed on the end face of each primary pole piece for further shaping the spatial configuration of the plurality of distinct, contiguous, magnetic field regions comprises a poletip composed of a magnetically susceptible material and having a planar face parallel to the string plane, said face having a configuration similar to an isosceles trapezoid, the parallel edges of said poletip face being oriented perpendicularly with respect to the linear segment of the corresponding string.

27. The variable reluctance pickup of claim 26, wherein the planar poletip has a unique long base dimension at least equal to a distance between the secondary pole pieces of the magnetic circuit elements adjacent to the primary pole piece on which said poletip is disposed.

28. The variable reluctance pickup of claim 26, wherein the planar poletip face has a maximum long base dimension equal to a distance between the secondary pole pieces of magnetic circuit element adjacent to the primary pole piece on which said poletip is disposed.

29. The variable reluctance pickup of claim 26, wherein each of said coils has an inside lead and an outside lead and wherein those coils disposed around the primary pole pieces positioned contiguous the north ends of said magnetic elements are referred to as a "north polarity series of coils" and those coils disposed around the primary pole pieces positioned contiguous the south ends of said magnetic elements are referred to as a "south polarity series of coils", said north polarity series of coils electrically connected with the inside lead of a first coil in said north polarity series being electrically connected to the outside lead of the adjacent coil in said north polarity series of coils which coil, in turn, has its inside lead connected to the outside lead of the adjacent coil thereto in said north polarity series, the last coil in said north polarity series of coils having its inside lead adapted for connection with a terminal of an amplifying means, said first coil in said north polarity series having its outside lead connected to the outside lead of a first coil in said south polarity series of coils, said inside lead of said first coil of the south polarity series of coils being connected to the outside lead of the adjacent coil thereto in the south polarity series of coils, which in turn has its inside lead connected to the outside lead of the adjacent coil thereto in said south polarity series of coils a last coil in said south polarity series of coils having its inside lead adapted for electrical connection to a second terminal of said amplifying means whereby said coils are electrically connected in series in a humbucking arrangement.

30. The variable reluctance pickup of claim 26 further defined in that said magnetic elements, said primary pole pieces, said secondary pole pieces, said pole tip faces and said coils are all potted in a rigid, insulative material to thereby form a solid body.

* * * * *